United States Patent [19]

Steuer

[11] 4,133,305

[45] Jan. 9, 1979

[54] RELAXATION APPARATUS INCLUDING MATTRESS AND PNEUMATIC VIBRATING DEVICE

[76] Inventor: Rudolf Steuer, Oudelandstraat 54, 's-Gravenzande, Netherlands

[21] Appl. No.: 777,156

[22] Filed: Mar. 11, 1977

[30] Foreign Application Priority Data

Mar. 17, 1976 [DE] Fed. Rep. of Germany ..... 2611151

[51] Int. Cl.[2] ..... A61H 1/00

[52] U.S. Cl. ..... 128/33; 128/1C; 128/28

[58] Field of Search ..... 128/32, 33, 24.1, 24.2, 128/1 C, 28; 5/108, 109, 348 R, 348 WB

[56] References Cited

U.S. PATENT DOCUMENTS

| | | | |
|---|---|---|---|
| 2,437,006 | 3/1948 | Simpson | 128/33 |
| 3,085,568 | 4/1963 | Whitesell | 128/33 |
| 3,392,723 | 7/1968 | Calvin | 128/24 R |
| 3,419,923 | 1/1969 | Cowan | 5/348 X |
| 3,595,223 | 7/1971 | Castagna | 128/33 |
| 3,919,730 | 11/1975 | Regan | 5/348 R |
| 4,003,374 | 1/1977 | Mizrachy | 128/48 |

*Primary Examiner*—Lawrence W. Trapp

[57] ABSTRACT

A relaxation apparatus includes a mattress consisting essentially of an inflatable hollow body defining an interior space and having an upper reclining surface area for carrying a human body. An air pump is connected to the hollow body for inflating it with air. A vibrating device cooperates with the pump for periodically varying the pressure in the interior space at a preselected frequency so as to raise and lower the reclining surface area periodically. The vibrating device includes a control system for varying the preselected frequency within a range containing the breathing rates.

17 Claims, 5 Drawing Figures

RELAXATION APPARATUS INCLUDING MATTRESS AND PNEUMATIC VIBRATING DEVICE

Figure 1:
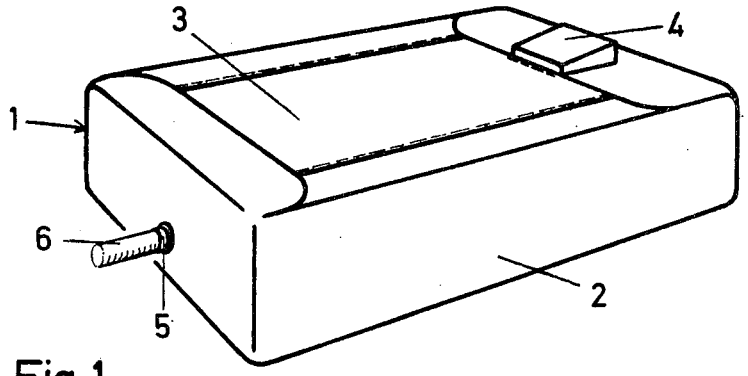

Many persons are suffering nowadays from nervous disorders caused by disturbances of everyday life. Due to their disturbed nervous system such persons will be unable in most cases to overcome these disorders by methodical physical, mental and physical relaxation. As a result thereof, there will arise psyochosomatic disorders of physical, mental and psychical character, such as headaches, insomnia, neuralgic problems, difficulties to concentrate, excessive weariness, claustrophobia, stage-fright, depressions or anxiety neuroses, to mention just a few of these disorders.

There are various methods known, such as yoga and autogeneous training that are designed to induce a state of total relaxation. However, such methods are only effective if a person will be able, in spite of the continuous flow of irritant sensations, to place himself in a state of inner tranquillity and relaxation for a longer period of time, an impossibility for a great number of persons.

Attempts have been made to provide auxiliary means designed to facilitate the relaxation of persons. One of these auxiliary means comprises a bed with a mattress which can vibrate at relatively high frequencies of very low amplitude, with the frame supporting the mattress being connected to a device which generates mechanical vibrations. However, beds of this type were found to be very limited usefulness because they do not accomodate the behavior and attitudes of the persons attempting to relax.

It is the aim of the invention to provide a mattress which can be set in vibration, which will positively boost the relaxation efforts by a person involved and which is able to keep this person in a state of relaxation over a long period of time.

The invention utilizes as basis for its solution of this problem a relaxation apparatus with a mattress which can be set in vibration and which is connected to a vibrating device.

The invention is characterized by the features that the mattress consists of an inflatable body, is made from a flexible material at least so far as its reclining area is concerned, and that the vibrating device comprises a control system with an adjustable control frequency, where the control system serves to vary periodically the internal pressure of the body.

The invention offers the advantage that the flexible reclining area will cling snugly to the skin of the person resting at it and will act intensively upon this person during the pneumatically produced vibration, thus allowing him to concentrate on the vibration and to adjust his respiratory frequency easily to the vibrating frequency. It becomes possible to set the vibrating frequency precisely at the magnitude which corresponds to the respiratory rhythm of the person in a state of total relaxation, or to adjust the vibrating frequency gradually in conformity with the specific respiratory rhythm of the individual person to allow his slow approach to optimum respiratory rhythm. The invention realizes and makes use in an advantageous manner of the fact that heavy and smooth breathing is an essential prerequisite for a total relaxation.

The invention also proposes as an advantageous further development to arrange the control system at the discharge side of a pump and to provide additional means which will permit changes in the mean pressure within the mattress and/or in the amplitude of the vibration, thus making it possible to adjust even the firmness of the reclining surface as well as the magnitude of the mattress vibration to the requisites of the individual person.

The invention will be explained below in detail by the use of a practical example and the enclosed drawing.

Figure 2:
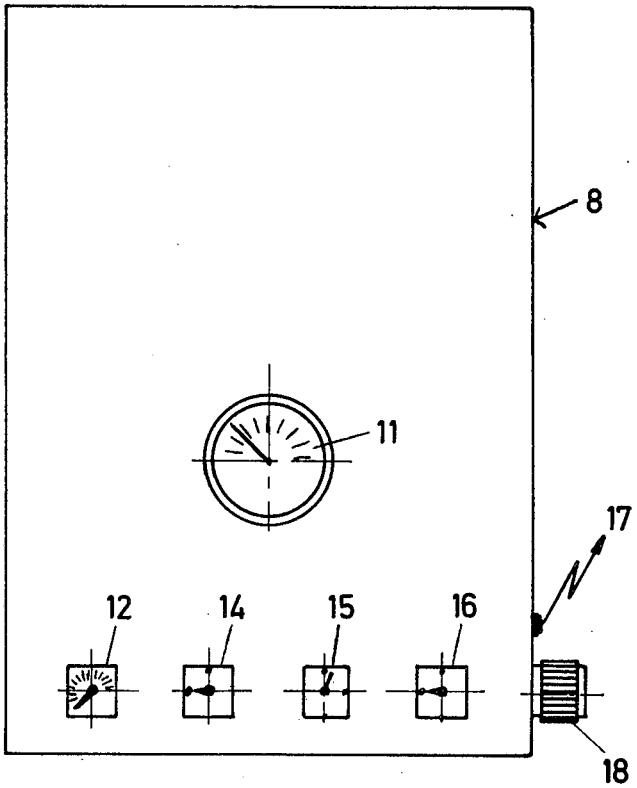
Figure 3:
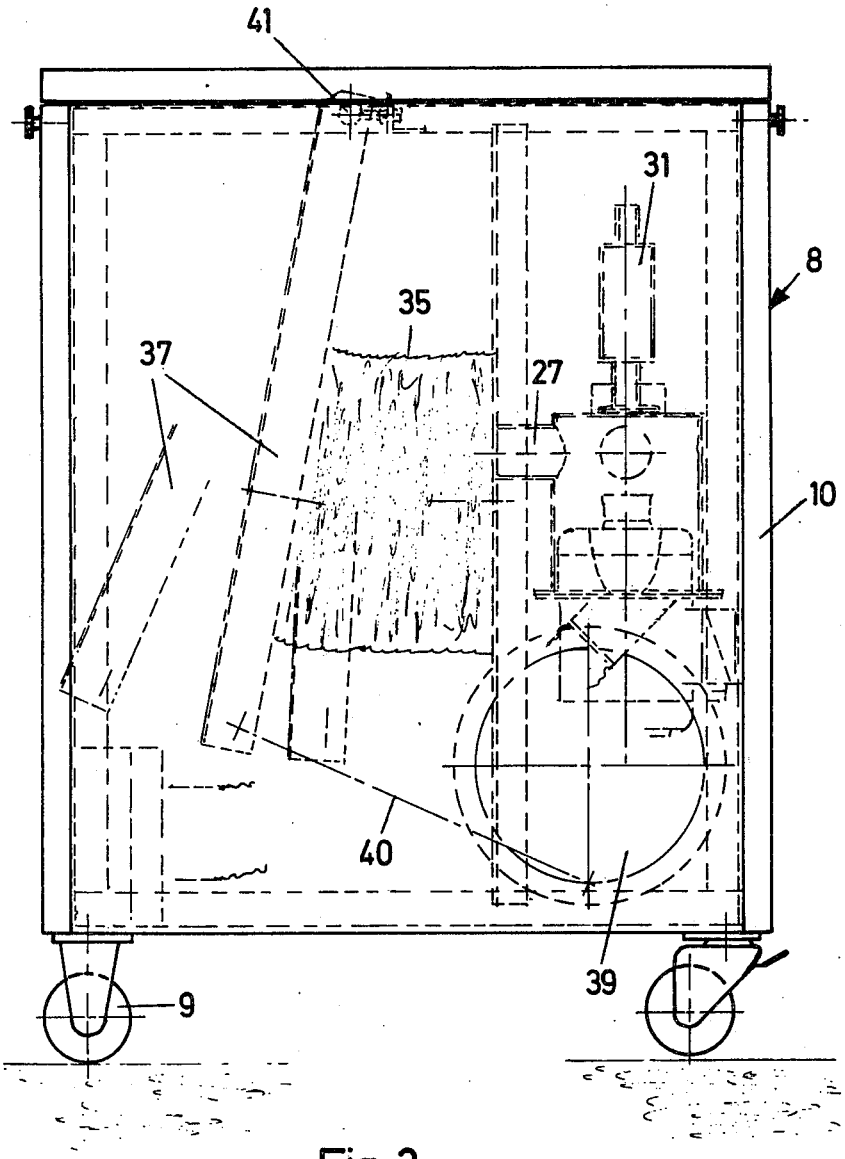
Figure 4:
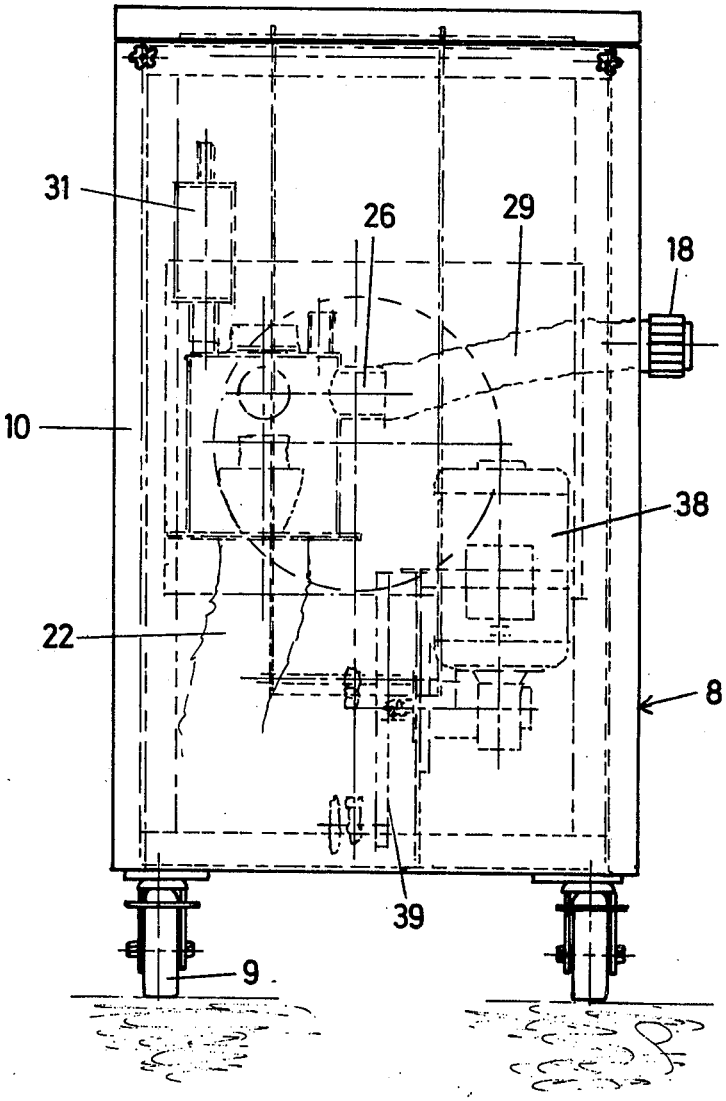
Figure 5:
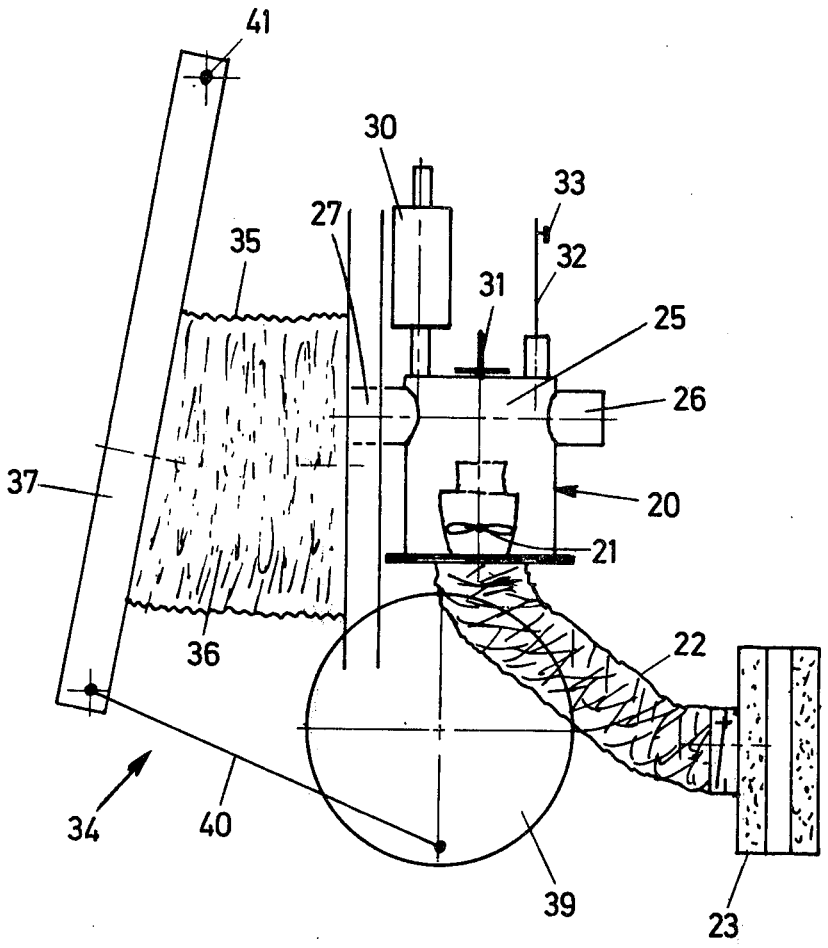

FIG. 1 gives a diagrammatic view of a mattress for the relaxation apparatus as proposed by the invention;

FIGS. 2 to 4 give a top, side and front view of a vibrating device for the relaxation apparatus proposed by the invention; and FIG. 5 gives a diagrammatic view of the vibrating device illustrated by FIGS. 2 to 4.

FIG. 1 shows a mattress 1 of the relaxation apparatus, consisting of a closed body 2, with a reclining area 3 located at its upper portion and made of a flexible material, for example a plastic-coated fabric. A headrest 4 is attached to one end of the reclining area 3. The body 2 is further provided with a coupling 5, by means of which the interior of the body 2 is connected by way of a tube 6 to a vibrating device as illustrated by FIGS. 2 to 5.

The vibrating device 8, as illustrated by FIGS. 2 to 5, comprises a supporting frame which is transportable by means of wheels 9 and which accomodates the other components of the vibrating device. The surface 10 of the supporting frame is designed as control panel, containing a pressure gage 11, an adjusting knob 12 for varying the control of vibration frequency, an on/off switch for the vibration 14, an adjusting knob 15 for varying the pressure, and an on/off switch for the pressure 16. At one side of the supporting frame 10 there are provided the mains junction box 17, connected to the switch 16, and a coupling 18 for the connection of the tube 6 leading to the mattress 1.

Within the supporting frame 10 there is arranged, as illustrated especially by FIG. 5, a pneumatic pump 20 and provided with a fan 21 which is connected to the switch 16 and is placed within one end of an intake duct 22. The other end of the intake duct 22 which leads to the open air by way of a filtering and muffling device 33 can be equipped with a flap valve 8.

The pneumatic pump 20 carries at the discharge side of the fan 21 a chamber 25 which is equipped with two fittings 26 and 27, the fitting 26 being connected to the coupling 18 by a tube 29. The chamber 25 is further in communication with a manometer 30, connected to the pressure gage 11, a safety valve 31 and a pipe 32 carrying an adjustable outlet valve 33 which leads to the open air and which is equipped with a control unit for the adjustment of the flow profile, this unit being connected with the adjusting knob 15.

The fitting 27 is connected to a control system 34 with an adjustable control frequency. The control system 34 possesses an area 36 which is limited by a bellows 35, connected flow-wise with the chamber 25 and which is further delimited by a pressure plate 37 that is located at the open side of the bellows 35 and is fastened to this bellows. The control system 34 contains further a motor 38, mounted within the supporting frame 10, the drive shaft of the motor connected either directly or by way of a gearing with the shaft of a crank disk 39. One end of a connecting rod 40 is hinged to the crank disk 39, and the other end is hinged to the pressure plate 37 which is swivel-mounted at point 41.

The mains junction box 17 and the wire terminals of the motor 38 are connected by way of electric lines with a, not illustrated, control circuit to which are also connected the adjusting knob 12 and the switch 14. The control circuit serves to regulate the speed of the motor 38 and may comprise a standard thyristor control system if a d.c. motor is being used.

The above described relaxation apparatus operates in the following manner:

When the fan 21 is turned on by actuation of the switch 16, a pressure will build up in the mattress 1, its magnitude corresponding to the pressure established by the safety valve 31 with the outlet valve 33 being closed, such pressure equaling for example 110 mm of hydraulic head in excess of atmospheric pressure. This pressure can be lowered if necessary to a magnitude of approximately 70 mm of hydraulic head by opening the outlet valve 33 by way of the adjusting knob 15. The switch 14 is then actuated, thus energizing the motor 38. The speed of the motor 38 can be regulated by way of the adjusting knob 12 in such manner that the crank disk 39 will rotate at speeds ranging from 0 to 150 r.p.m. The rotation of the crank disk 39 causes the pressure plate 37 to oscillate about the point 41 between the two extreme positions indicated in FIG. 3, thereby cyclically increasing and decreasing the area 36, and thereby the pressure within the mattress, with the result that the reclining surface 3 will move up and down. It will be expedient to set the speed of the crank disk 39, or the control or vibration frequency respectively, initially at a magnitude that corresponds approximately to the respiratory frequency at the beginning of the relaxation process, and then to lower this value gradually until the breathing of the person resting on the reclining surface has adjusted itself to the frequency typical for a total relaxation.

The invention is not limited to the example described above but can be modified in many ways. For example, the entire mattress can consist of a flexible cover which is preferably made from a fabric that is coated with a plastic material and is provided at its inside with a rope bracing, and the reclining area can also be covered by a removable sheet. It is also feasible to to arrange the pneumatic vibrating device inside the mattress, and in this case the coupling 5 could serve as intake manifold. In the case of a preferred further development of the invention there are provided at the crank disk 39 several places for the attachment of the connecting rod 40, these places being located at various radical distances from the center of the crank disk 39. By fastening the connecting rod 40 selectively to one or another of these places it becomes thus possible to adjust the amplitude of the vibration, or the oscillation of the reclining surface 3 respectively, in such manner that it will match the specific needs of an individual person.

In still further development of the invention it is possible to add a heating aggregate to the relaxation apparatus, comprising several sets of infrared and possibly also ultraviolet lamps which can be turned on by groups, the reason being that properly applied heat will also enchance the relaxation process.

Finally, it is also possible to bring a person resting on the reclining surface into a state of excitation by increasing the vibrating frequency.

I claim:

1. A relaxation apparatus comprising: a mattress consisting essentially of an inflatable hollow body defining an interior space and having an upper reclining surface area made of a flexible material for carrying a human body in its entirety; an air pump connected to said hollow body for inflating said hollow body with air and for creating and maintaining a preselected pressure in the interior space of said hollow body; and vibrating means cooperating with said pump for periodically varying with a preselected frequency said pressure in the interior space of said hollow body and for periodically raising and lowering said reclining surface area, said vibrating means including a control system for varying said preselected frequency within a range containing breathing rates.

2. A relaxation apparatus according to claim 1, wherein said control system includes means for varying the amplitude of the periodic pressure variations.

3. A relaxation apparatus according to claim 2, wherein said means for varying the amplitude of said periodic pressure variations includes a connecting rod and a crank disk provided with several hinging points for said connecting rod, said hinging points being placed at respective different radial distances from the center of said crank disk.

4. A relaxation apparatus, according to claim 1, wherein said hollow body consists of a flexible cover.

5. A relaxation apparatus according to claim 1, wherein said pump, said vibrating means and said control system are positioned outside said mattress and further including a tube connected between said interior space of said body and said vibrating means.

6. A relaxation apparatus according to claim 1, wherein said vibrating means is arranged at the discharbe side of said pump.

7. A relaxation apparatus according to claim 6, including a tube and a chamber, and wherein said pump is connected at its discharge side with a chamber which is connected by said tube with the interior space of said hollow body and wherein said vibrating means comprises a space of variable volume which is connected with said chamber.

8. A relaxation apparatus according to claim 7, wherein said space of variable volume is formed by a bellows, one of its ends connected flowwise with said chamber and its other end fastened to a swivel-mounted pressure-plate which is hinged to a connecting rod, said rod being hinged to a crank disk.

9. A relaxation apparatus, according to claim 8, wherein said control system includes a motor of variable speed having a drive shaft which is connected to said crank disk.

10. A relaxation apparatus according to claim 9, including an adjusting knob connected to said motor to effect a change in its speed.

11. A relaxation apparatus according to claim 1, including a safety valve provided at the discharge side of said pump.

12. A relaxation apparatus according to claim 1, wherein said control system further includes an adjustable outlet valve arranged at the discharge side of said pump for varying mean pressure in said interior space of said hollow body.

13. A relaxation apparatus according to claim 1, wherein a manometer is provided at the discharge side of said pump.

14. A relaxation apparatus according to claim 1, including a safety valve, an outlet valve and a manometer each of which is connected to said chamber.

15. A relaxation apparatus according to claim 7, including a safety valve connected to said chamber.

16. A relaxation apparatus according to claim 7, including an outlet valve connected to said chamber.

17. A relaxation apparatus according to claim 7, including a manometer connected to said chamber.

* * * * *